US005967905A

United States Patent [19]

Nakahara et al.

[11] Patent Number: 5,967,905

[45] Date of Patent: Oct. 19, 1999

[54] GOLF CLUB HEAD AND METHOD FOR PRODUCING THE SAME

[75] Inventors: Norihiko Nakahara; Shinji Yamamoto, both of Hiratsuka; Shigeki Ono; Toru Yoshida, both of Okegawa, all of Japan

[73] Assignees: The Yokohama Rubber Co., Ltd.; Mitsubishi Materials Corporation, both of Tokyo, Japan

[21] Appl. No.: 09/025,439

[22] Filed: Feb. 17, 1998

[30] Foreign Application Priority Data

Feb. 17, 1997 [JP] Japan ..... 9-032391

[51] Int. Cl.[6] ..... A63B 53/04

[52] U.S. Cl. ..... 473/345; 473/349; 473/409

[58] Field of Search ..... 473/324, 328, 473/345, 346, 349, 334, 335, 336, 337, 338, 339, 344, 409

[56] References Cited

U.S. PATENT DOCUMENTS 4,630,825 12/1986 Schmidt et al. .
4,795,159 1/1989 Nagamoto .
5,294,037 3/1994 Schmidt .
5,564,705 10/1996 Kobayashi .
5,658,207 8/1997 Aizawa .
5,669,825 9/1997 Shira .
5,720,673 2/1998 Anderson .

*Primary Examiner*—Sebastiano Passaniti
*Attorney, Agent, or Firm*—Finnegan, Henderson, Farabow, Garrett & Dunner, L.L.P.

[57] ABSTRACT

A golf club head comprises an outer titanium club-head shell, and a titanium sole portion integrally coupled to the outer club-head shell. A weight fitting hole is bored in the sole portion, and a plurality of cutouts are formed in the inner peripheral edge portion of the fitting hole. A weight made of metal having a specific gravity higher than that of titanium is inserted into the fitting hole, and the weight is fixed to the sole portion after press-deformed so that its outer peripheral edges are press-fitted into the respective cutouts. A method for producing a golf club head comprises the steps of molding the outer club-head shell from titanium, molding the sole portion having the weight fitting hole from titanium, forming the plurality of cutouts in the inner peripheral edge portion of the fitting hole of the sole portion, inserting the weight made of metal having a specific gravity higher than that of titanium into the fitting hole, fixing the weight to the sole portion by press-deforming the weight in such a way as to press-fit the outer peripheral edges of the weight into the respective cutouts, and coupling the outer club-head shell and the sole portion integrally by welding.

12 Claims, 3 Drawing Sheets

GOLF CLUB HEAD AND METHOD FOR PRODUCING THE SAME

BACKGROUND OF THE INVENTION

The present invention relates to a golf club head and a method for producing the same, and more particularly to such a golf club head as a titanium golf club head whose sole portion can be fitted securely with a weight made of metal having a high specific gravity through simple fitting work and to a method for producing the same.

Heretofore, it has been attempted to lower the center of gravity by fitting to a sole portion a weight made of metal whose specific gravity is higher than that of titanium in the case of a typical conventional golf club head made of titanium having a low specific gravity.

Since titanium and metal having a high specific gravity for use in a weight are different kinds of metal, a brittle intermetallic compound tends to be formed when both of them are welded together and this has made it difficult to fit the weight by welding to the sole portion made of titanium. Consequently, the methods employed for fitting the weight to the sole portion have been to use clamping means such as bolts and nuts in general and to use such a metal material as an intermediate material weldable to both the sole portion and the weight.

However, the former method of using the clamping means requires not only using special bolts and nuts which are large and thin but also a great deal of trouble and time for fitting the weight to the sole portion, and makes the weight fitting strength insufficient.

The latter method of using the intermediate material between the sole portion and the weight needs to machine the intermediate material properly beforehand and to mount the weight on the intermediate material after mounting the intermediate material on the sole portion; the problem is that a great deal of trouble and time is also required during the assembling work.

SUMMARY OF THE INVENTION

An object of the present invention is to provide a golf club head and a method for producing the same that enable to facilitate the assembling work for fitting a weight made of metal other than titanium to a sole portion of the titanium golf club head, with the weight securely fixed to the sole portion.

In order to accomplish the object above, a golf club head according to the present invention comprises an outer titanium club-head shell, and a titanium sole portion integrally coupled to the outer club-head shell wherein a weight fitting hole is bored in the sole portion; a plurality of cutouts are formed in the inner peripheral edge portion of the fitting hole; a weight made of metal having a specific gravity higher than that of titanium is inserted into the fitting hole; and the weight is fixed to the sole portion after press-deformed so that its outer peripheral edges are press-fitted into the respective cutouts.

In order to accomplish the object above, a method for producing a golf club head according to the present invention comprises the steps of molding an outer club-head shell from titanium, molding a sole portion having a weight fitting hole from titanium, forming a plurality of cutouts in the inner peripheral edge portion of the fitting hole of the sole portion, inserting a weight made of metal having a specific gravity higher than that of titanium into the fitting hole, fixing the weight to the sole portion by press-deforming the weight in such a way as to press-fit the outer peripheral edges of the weight into the respective cutouts, and coupling the outer club-head shell and the sole portion integrally by welding.

According to the present invention, titanium is used as the general term for pure titanium and titanium alloy.

As set forth above, the plurality of cutouts are formed in the inner peripheral edge portion of the fitting hole, and the weight made of metal having the high specific gravity is inserted into the fitting hole and fixed to the sole portion after press-deformed so that its outer peripheral edges are press-fitted into the respective cutouts, whereby even when the titanium club head is fitted with the weight made of a different kind of metal, man-hours for machining are reduced with the effect of facilitating assembling work and besides the weight is deformed so that its outer peripheral edges bite into the respective cutouts to ensure that the weight is fixed to the sole portion because these cutouts function as detents of the weight.

In the present invention, further, a stair-like stepped portion extending in the thickness direction of the sole is formed in the inner peripheral edge portion of the fitting hole, and the weight is press-deformed so that its outer peripheral edges clamp both the inner and outer faces of the inner peripheral edge portion, whereby no gap is produced between the weight and the fitting hole. Thus, not only water but also dust is effectively prevented from penetrating into the club head.

Moreover, a sealing material is poured into the gap between the fitting hole and the weight to ensure that the weight is fixed to the sole portion even though the dimensional precision of the fitting hole and the weight is low. Thus, not only water but also dust is effectively prevented from penetrating into the club head, and an unpleasant noise to be caused by the vibration of the weight itself can also be prevented.

The present invention is applicable to both wood type and iron type golf club heads. According to the present invention, it is therefore possible to readily produce a wood type or an iron type golf club head whose center of gravity is lowered.

BRIEF DESCRIPTION OF THE DRAWINGS

FIG. 3 is a plan view taken on an arrow B—B of FIG. 1 in such a state that no weight is fitted in.

DETAILED DESCRIPTION OF THE PREFERRED EMBODIMENTS

Figure 1:
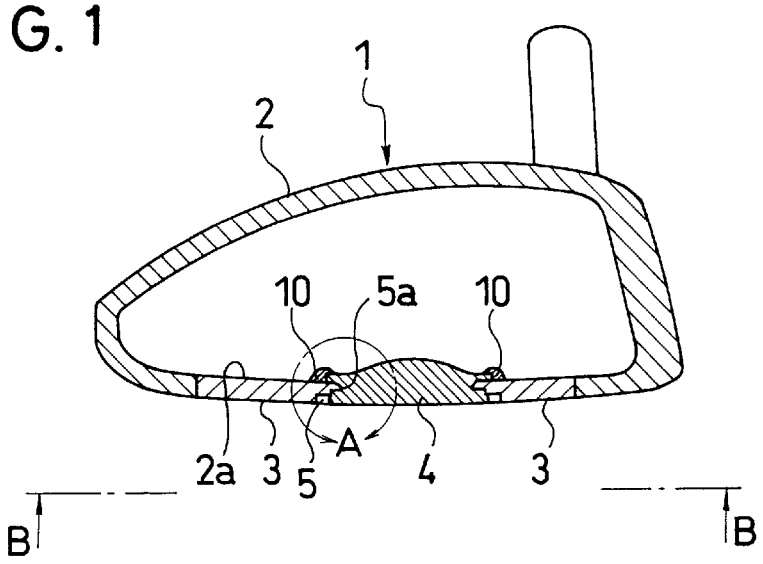
FIG. 1 is a vertical sectional side view of an exemplary wood type golf club head embodying the present invention.
Figure 2:
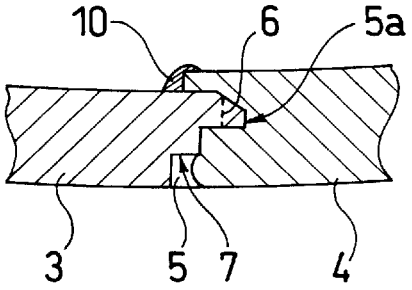
FIG. 2 is a partial enlarged sectional view of the portion A of FIG. 1.
Figure 3:
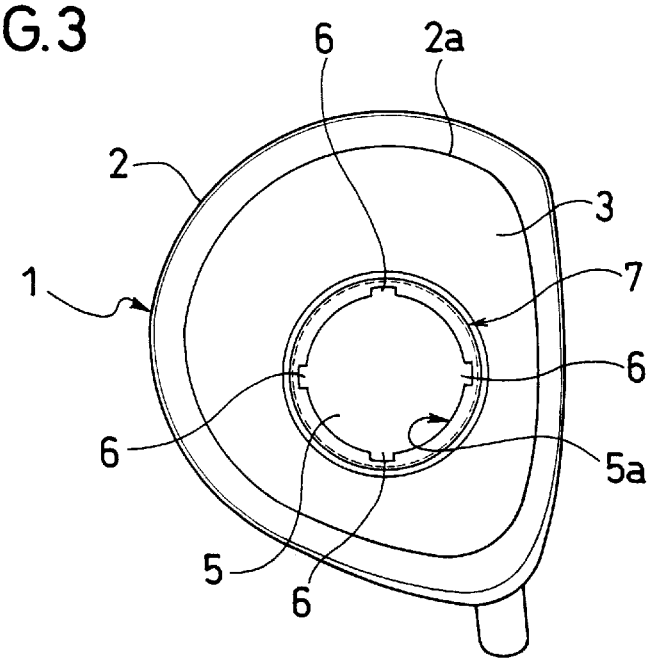

FIGS. 1–3 show an exemplary wood type golf club head embodying the present invention. As shown in FIGS. 1–3, the outer club-head shell 2 and the sole portion 3 of a club head body 1 are both molded from titanium, and the sole portion 3 is fitted by welding in the sole-side opening 2*a* of the outer club-head shell 2 so as to form a hollow structure. Incidentally, a plurality of members may be joined together by welding to form the outer club-head shell 2.

The fitting hole 5 for a weight 4 is provided in the sole portion 3, and a cutout 6 in the form of a recess is cut in a plurality of places (four places in this embodiment) of the inner peripheral edge portion 5*a* of the fitting hole 5. The weight 4 made of metal having a high specific gravity such as tungsten alloy is inserted into the fitting hole 5 of the weight 4 and then deformed by pressing from both sides of the sole portion 3 by means of a press or the like so that the outer peripheral edges of the weight 4 are press-fitted into the respective cutouts 6, whereby the weight 4 is fixed to the sole portion 3. The length of the cutouts 6 in the circumferencial direction of the fitting hole 5 may be increased so that the cutouts 6 occupy most of the inner peripheral edge portion 5*a* as if protrusions between the cutouts 6 were formed on the inner peripheral edge portion 5*a*.

Even when the weight 4 made of metal other than titanium is thus fitted in the club head made of titanium, the fitting work can simply be done through the steps of providing the fitting hole 5 for the weight 4 in the sole portion 3, forming the plurality of cutouts 6 in the inner peripheral edge portion 5*a* of the fitting hole 5, inserting the weight 4 made of metal having a high specific gravity into the fitting hole 5, press-deforming the weight 4 and fixing the deformed weight 4 to the sole portion 3. Since the weight 4 is deformed by the press or the like in such a way as to make its outer peripheral edges bite into the respective cutouts 6, the cutouts 6 function as detents of the weight 4 to ensure that the weight 4 is fixed firmly to the sole portion 3.

The weight 4 is preferably circular in cross section because it can be machinable with the highest precision. In order to give the disk-like weight 4 a detent function with respect to the fitting hole 5, it is preferred to make such a cutout 6 in at least more than one place. The plurality of cutouts 6 are thus provided for the fitting hole 5 to ensure that the weight 4 is fixed to the sole portion 3 while the weight 4 is prevented from rotational displacement even though it is circular in cross section into which it can be machinable with the highest precision.

Metal materials which are readily deformable when press-deformed by a press or the like such as steel, nickel alloy, for example, Inconel (Trademark, INCO LTD.), and tungsten alloy containing iron are usable for the weight 4, so that the weight 4 bites into the cutouts 6 when deformed.

Further, a stair-like stepped portion 7 extending in the thickness direction of the sole is formed in the inner peripheral edge portion 5*a* of the fitting hole 5 as shown in FIG. 2. The stair-like stepped portion 7 has inner diameters different from each other at two stages at least in that the inner diameter situated on the outer side of the sole is set greater than what is situated on the inner side of the sole. Then, the outer peripheral edges of the weight 4 thus press-deformed are caused to clamp both the inner and outer faces of the inner peripheral edge portion 5*a* of the fitting hole 5.

There may develop a gap between the weight 4 and the fitting hole 5 when a predetermined curvature is imparted to the sole portion 3 after the disk-like weight 4 is fixed to the sole portion 3. However, the formation of the stair-like stepped portion 7 in the inner peripheral edge portion 5*a* of the fitting hole 5 as stated above results in elongating the outer peripheral edges of the weight 4 thus press-deformed in the facial direction of the sole portion 3 so as to cover the gap between the weight 4 and the fitting hole 5, whereby it is possible to effectively prevent dust from being caught in the gap or water from penetrating into the club head.

Moreover, such a gap can be sealed up by pouring a sealing material into the gap produced between the fitting hole 5 and the weight 4. When the weight 4 is integrally secured to the sole portion 3 by pouring the sealing material into the gap between the fitting hole 5 and the weight 4, the weight 4 can be secured rigidly even though the dimensional accuracy of the fitting hole 5 and the weight 4 is low. Consequently, water, dust and the like are effectively prevented from penetrating into the club head. Moreover, the generation of unpleasant sound due to the vibration of the weight itself becomes preventable.

As the sealing material, use can be made of metal solder, adhesive material, paint and the like. The metal solder preferred for use is brazing filler metal (with a melting temperature of 450° or higher) available on the market now, which filler metal has sufficient strength after hardened and fixed and is not melted by heat generated when an outer titanium wall is formed by welding, the sealing material including silver solder, German silver solder, manganese solder, iron solder, aluminum solder and so forth in the range of melting temperatures of 600° C. to 900° C. in consideration of workability. Incidentally, silver solder is employed according to this embodiment of the present invention as what is most preferred for use in view of fluidity. It is however needed to select a proper soldering material and flux in accordance with the material used for the weight.

Although a description has been given of a wood type golf club head in the above-described embodiment of the present invention, the invention is also applicable to a hollow iron type golf club head.

Figure 4:
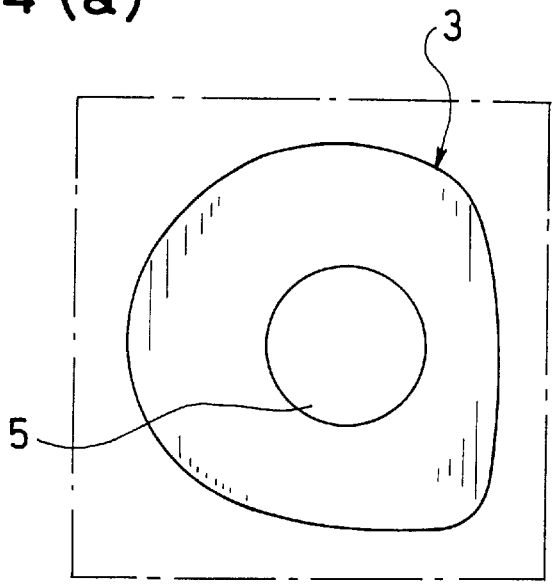
FIGS. 4(*a*)–4(*f*) illustrate steps of manufacturing a club head, and FIG. 4(*g*) a plan view taken on an arrow C—C of FIG. 4(*d*).
Figure 4:
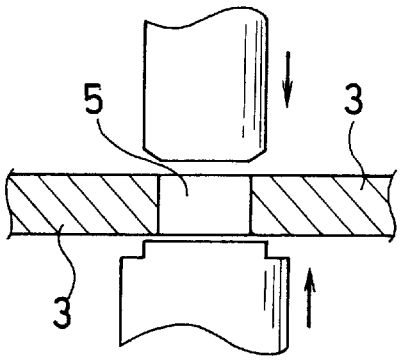
Figure 4:
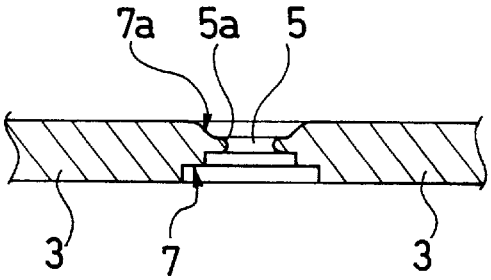
Figure 4D:
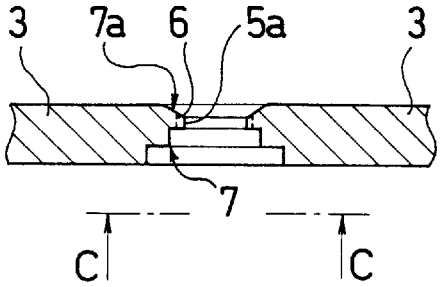
Figure 4E:
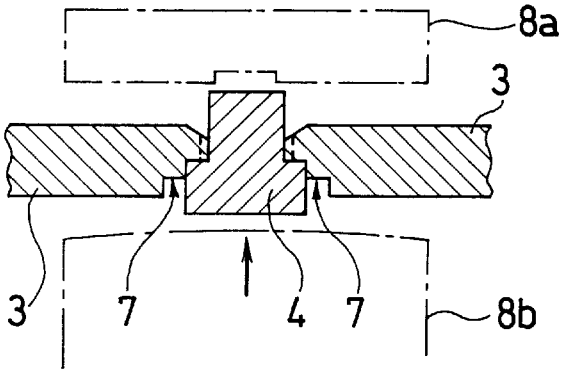
Figure 4F:
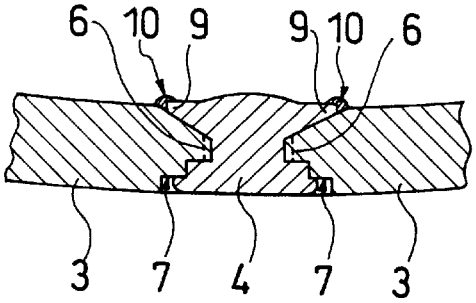
Figure 4G:
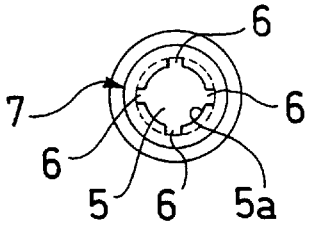

A method for producing the golf club head will subsequently be described by referring to FIGS. 4(*a*)–4(*g*). As shown in FIG. 4(*a*) first, the outer club-head shell 2 and the sole portion 3 having the fitting hole 5 for the weight 4 are molded from titanium by forging, pressing (punching) or the like.

As shown in FIGS. 4(*b*) and 4(*c*), the sole portion 3 is subjected to pressing in order to form the stair-like stepped portion 7 on the outer face side of the inner peripheral edge portion 5*a* of the fitting hole 5, and a slope 7*a* on the inner face side of the sole of the inner peripheral edge portion 5*a*. As shown in FIGS. 4(*d*)–4(*g*) further, a plurality of cutouts 6 in the form of a recess are formed at intervals of 90° in the inner peripheral edge portion 5*a* protruding inward in the diametrical direction between the stepped portion 7 and the slope 7*a*.

As shown in FIG. 4(*e*) further, the weight 4 made of metal having a high specific gravity is fitted into the fitting hole 5 before being subjected to pressing by means of pressing means 8*a*, 8*b*. As shown in FIG. 4(*f*), the weight 4 can be fixed firmly to the sole portion 3 then because the outer peripheral edges of the weight 4 thus press-deformed bite into the respective cutouts 6. Since the outer peripheral edges of the weight 4 simultaneously elongate in the facial direction of the sole portion 3 so as to cover the gap between the weight 4 and the fitting hole 5, dust is prevented from being caught in the gap and water is also prevented from penetrating into the club head. Moreover, the overhanging portion 9 of the weight 4 may be caulked to ensure that even though the weight 4 becomes large-sized, it is rigidly secured to the sole portion 3.

Further, it is possible to seal up the gap produced between the fitting hole 5 and the weight 4 as occasion demands by pouring a sealing material into the gap after the weight 4 is press-deformed. The sealing material is thus poured into the gap between the fitting hole 5 and the weight 4 to fix the weight 4 firmly and integrally to the sole portion in this manner to ensure that even though the dimensional precision of the fitting hole 5 and the weight 4 is low, the weight 4 is firmly fixed to the sole portion 3. Moreover, not only water but also dust is effectively prevented from penetrating into the club head and besides the generation of unpleasant sound due to the vibration of the weight itself becomes preventable. The weight 4 is also effectively prevented from slipping off the sole portion 3 by applying lap fillet welding 10 to the overhanging portion 9 of the weight 4.

Subsequently, as shown in FIG. 4(*f*), the sole portion 3 is bent with a predetermined curvature so that the stepped portion 7 is situated on the outer face side of the sole. The sole portion 3 thus formed is integrally fitted by welding to the sole-side opening 2*a* of the outer club-head shell 2.

The golf club head is thus produced through the above-described method, so that even when the weight 4 made of metal different from what forms the club head is fitted to the club head mainly made of titanium or titanium alloy, man-hours for machining are reducible with the effect of facilitating assembling work to ensure that the weight 4 is fixed to the sole portion 3.

What is claimed is:

1. A golf club head comprising an outer titanium club-head shell, and a titanium sole portion integrally coupled to the outer club-head shell wherein a weight fitting hole is bored in said sole portion; a plurality of cutouts are formed in an inner peripheral edge portion of said fitting hole; a weight made of metal having a specific gravity higher than that of titanium is inserted into said fitting hole; and said weight is fixed to said sole portion by being press-deformed so that outer peripheral edges of the weight are press-fitted into said respective cutouts.

2. A golf club head as claimed in claim 1, wherein the inner peripheral edge portion of said fitting hole include inner and outer faces and is formed stepwise in the thickness direction of the sole portion; and said weight is press-deformed so that its outer peripheral edges clamp both the inner and outer faces of said inner peripheral edge portion.

3. A golf club head as claimed in claim 1, wherein said metal having a higher specific gravity is at least a metal selected from the group consisting of steel, nickel alloy and tungsten alloy.

4. A golf club head as claimed in claim 1, wherein a sealing material is poured into a gap between said fitting hole and said weight to seal up said gap.

5. A golf club head as claimed in claim 4, wherein said sealing material is metal solder.

6. A golf club head as claimed in claim 1 that is a wood type golf club head.

7. A golf club head as claimed in claim 1 that is an iron type golf club head.

8. A method for producing a golf club head comprising the steps of molding an outer club-head shell from titanium, molding a sole portion having a weight fitting hole from titanium, forming a plurality of cutouts in a inner peripheral edge portion of said fitting hole of said sole portion, inserting a weight made of metal having a specific gravity higher than that of titanium into said fitting hole, fixing said weight to said sole portion by press-deforming said weight in such a way as to press-fit outer peripheral edges of said weight into said respective cutouts, and coupling said outer club-head shell and said sole portion integrally by welding.

9. A method for producing a golf club head as claimed in claim 8, further comprising the steps of forming the inner peripheral edge portion of said fitting hole stepwise in the thickness direction of the sole portion, wherein said inner peripheral edge portion includes inner and outer faces; and press-deforming said weight so that its outer peripheral edges clamp both the inner and outer faces of said inner peripheral edge portion.

10. A method for producing a golf club head as claimed in claim 8, wherein said metal having a higher specific gravity is at least one metal selected from the group consisting of steel, nickel alloy and tungsten alloy.

11. A method for producing a golf club head as claimed in claim 8, further comprising the step of pouring a sealing material into a gap between said fitting hole and said weight to seal up said gap.

12. A method for producing a golf club head as claimed in claim 11, wherein said sealing material is metal solder.

* * * * *